US008392181B2

(12) United States Patent
Archibald et al.

(10) Patent No.: US 8,392,181 B2
(45) Date of Patent: Mar. 5, 2013

(54) SUBTRACTION OF A SHAPED COMPONENT OF A NOISE REDUCTION SPECTRUM FROM A COMBINED SIGNAL

(75) Inventors: Fitzgerald John Archibald, Kanyakumari district (IN); Karthik Swaminathan, Bangalore (IN); Anil Kumar Sirikande, Hyderabad (IN)

(73) Assignee: Texas Instruments Incorporated, Dallas, TX (US)

( * ) Notice: Subject to any disclaimer, the term of this patent is extended or adjusted under 35 U.S.C. 154(b) by 919 days.

(21) Appl. No.: 12/493,256

(22) Filed: Jun. 29, 2009

(65) Prior Publication Data

US 2010/0063807 A1 Mar. 11, 2010

(51) Int. Cl.
*G10L 21/00* (2006.01)

(52) U.S. Cl. ..... 704/226; 704/233; 375/227

(58) Field of Classification Search ..... 704/226, 704/233; 375/227

See application file for complete search history.

(56) References Cited

U.S. PATENT DOCUMENTS

| | | | | |
|---|---|---|---|---|
| 6,266,633 | B1 * | 7/2001 | Higgins et al. | 704/224 |
| 6,324,502 | B1 * | 11/2001 | Handel et al. | 704/226 |
| 6,510,408 | B1 * | 1/2003 | Hermansen | 704/233 |
| 2008/0192956 | A1 * | 8/2008 | Kazama | 381/94.3 |
| 2008/0287086 | A1 * | 11/2008 | Gozen | 455/311 |

OTHER PUBLICATIONS

T. F. Quatieri, "Discrete-Time Speech Signal Processing: Principles and Practice", 1st ed., Pearson Education, Inc., 2006, Massachusetts Institute of Technology.

G. R. Steber, "Digital Signal Processing in Automatic Gain Control Systems", Industrial Electronics Society, Oct. 1988, Milwaukee, Wisconsin.

S. F. Boll, "A Spectral Subtraction Algorithm for Suppression of Acoustic Noise in Speech", Acoustics, Speech, and Signal Processing, Apr. 1979, Salt Lake City, Utah.

R. Yates, "Fixed-Point Arithmetic: An Introduction" Mar. 3, 2001.

F. J. Harris, "On the Use of Windows for Harmonic Analysis with the Discrete Fourier Transform", Proceedings of the IEEE, Jan. 1978.

F. J. Archibald, "An Efficient Stepper Motor Audio Noise Filter" Texas Instruments White Paper, Jul. 2008.

J. Wei, L. Du, Z. Yan, H. Zeng, "A New Algorithm for Voice Activity Detection", Institute of Acoustics, Chinese Academy of Sciences, May 2004, Beijing, China.

R. E. Crochiere, "A Weighted Overlap-Add Method of Short Time Fourier Analysis/Synthesis", IEEE Transactions on Acoustics, Speech, and Signal Processing, Feb. 1980.

F. J. Archibald, "Software Implementation of Automatic Gain Controller for Speech Signal", Texas Instruments White Paper, Jul. 2008.

(Continued)

*Primary Examiner* — Daniel D Abebe

(74) *Attorney, Agent, or Firm* — Mirna Abyad; W. James Brady; Frederick J. Telecky, Jr.

(57) ABSTRACT

A system and methods of subtraction of a shaped component of a noise reduction spectrum from a combined signal are disclosed. In an embodiment, a method includes identifying a selected frequency component using a corresponding frequency component of a noise sample spectrum. A noise set is comprised of the noise sample spectrum. The method further includes forming a shaped component of a noise reduction spectrum using a processor and a memory based on a combined signal spectrum and the selected frequency component. The method also includes subtracting the shaped component of the noise reduction spectrum from the combined signal spectrum.

18 Claims, 9 Drawing Sheets

OTHER PUBLICATIONS

H. V. Sorensen, M. T. Heideman, and C. S. Burrus, "On Computing the Split-Radix FFT", IEEE Transactions on Acoustics, Speech and Signal Processing, Feb. 1986.

Y. Lin, H. Liu and C. Lee, "A Dynamic Scaling FFT Processor for DVB-T Applications", iEEE Journal of Solid-State Circuits, Nov. 2004.

T. Widhe, J. Melander and L. Wanhammar, "Design of Efficient Radix-8 Butterfly PEs for VLSI", Jun. 1999, Hong Kong.

S. F. Boll, "Suppression of Noise in Speech Using the Saber Method", Apr. 1978, Salt Lake City, Utah.

K. K. W'Ojcicki, B. J. Shannon and K. K. Paliwal, "Spectral Subtraction with Variance Reduced Noise Spectrum Estimates", Dec. 2006, Australia.

B. J. Shannon and K. K. Paliwal, "Role of Phase Estimation in Speech Enhancement", Sep. 2006, Australia.

J. Tihelka and P. Sovka, "Implementation Effective One-Channel Noise Reduction System", Eurospeech 2001—Scandinavia.

* cited by examiner

SUBTRACTION OF A SHAPED COMPONENT OF A NOISE REDUCTION SPECTRUM FROM A COMBINED SIGNAL

CLAIM OF PRIORITY

This application claims priority from Indian Provisional Application No. 2191/CHE/2008 filed on Sep. 10, 2008.

FIELD OF TECHNOLOGY

This disclosure relates generally to signal processing and more particularly to a system and methods of subtraction of a shaped component of a noise reduction spectrum from a combined signal.

BACKGROUND

A background noise may interfere with a clarity of a speech signal. The background noise may vary over time or due to environmental conditions. A filter may reduce the background noise, but the filter may not correlate with the background noise. As a result, the filter may fail to reduce a part of the background noise. The filter may also reduce an additional part of the speech signal below a threshold tolerance. The speech signal may therefore become distorted or reduced, and a part of the noise signal may continue to interfere with the clarity of the speech signal.

SUMMARY

This Summary is provided to comply with 37 C.F.R. §1.73. It is submitted with the understanding that it will not be used to limit the scope or meaning of the claims.

Several methods and a system of subtraction of a shaped component of a noise reduction spectrum from a combined signal are disclosed. An exemplary embodiment provides a method that includes identifying a selected frequency component using a corresponding frequency component of a noise sample spectrum. A noise set includes the noise sample spectrum. The method further includes forming a shaped component of a noise reduction spectrum using a processor and a memory based on a combined signal spectrum and the selected frequency component. The method also includes subtracting the shaped component of the noise reduction spectrum from the combined signal spectrum.

An additional exemplary embodiment provides a system that includes a noise spectrum estimator module to identify a selected frequency component using a corresponding frequency component of a noise sample spectrum. A noise set includes the noise sample spectrum. The system includes a noise spectrum shaping module to form a shaped component of a noise reduction spectrum using a processor and a memory based on a combined signal spectrum and the selected frequency component. The system further includes a spectral subtraction module to subtract the shaped component of the noise reduction spectrum from the combined signal spectrum.

A further exemplary embodiment provides a method that includes obtaining a noise sample spectrum using at least one of a prerecorded sample of a background noise and a locally characterized sample of the background noise. The method also includes identifying a selected frequency component using a corresponding frequency component of a noise sample spectrum. A noise set includes the noise sample spectrum. The noise sample spectrum is obtained using at least one of a prerecorded sample of a background noise and a locally characterized sample of a background noise.

The method further includes algorithmically determining whether to use the selected frequency component to generate a shaped component of the noise reduction spectrum. A threshold value is used to algorithmically determine whether to use the selected frequency component to generate a shaped component of the noise reduction spectrum. The threshold value is includes a combined signal frequency component multiplied by an amplification factor.

The method further includes forming the shaped component of a noise reduction spectrum using a processor and a memory based on a combined signal spectrum and the selected frequency component. The shaped component of a noise reduction spectrum includes a largest corresponding frequency component of the noise set when the largest corresponding frequency component is less than a threshold value. The shaped component of a noise reduction spectrum includes an average of corresponding frequency components of the noise set when a largest corresponding frequency component is greater than a threshold value.

The method also includes subtracting the shaped component of the noise reduction spectrum from the combined signal spectrum. The method further includes reconstructing an adaptively filtered speech signal, and normalizing a signal level of a reconstructed speech signal.

The methods, systems, and apparatuses disclosed herein may be implemented in any means for achieving various aspects, and may be executed in a form of a machine-readable medium embodying a set of instructions that, when executed by a machine, cause the machine to perform any of the operations disclosed herein. Other aspects and example embodiments are provided in the Drawings and the Detailed Description that follows.

BRIEF DESCRIPTION OF THE VIEWS OF DRAWINGS

Example embodiments are illustrated by way of example and not limitation in the figures of the accompanying drawings, in which like references indicate similar elements and in which.

Other features of the present embodiments will be apparent from the accompanying Drawings and from the Detailed Description that follows.

DETAILED DESCRIPTION

Disclosed are several methods and a system of subtraction of a shaped component of a noise reduction spectrum from a combined signal.

Although the present embodiments have been described with reference to specific example embodiments, it will be evident that various modifications and changes may be made to these embodiments without departing from the broader spirit and scope of the various embodiments.

Figure 1:
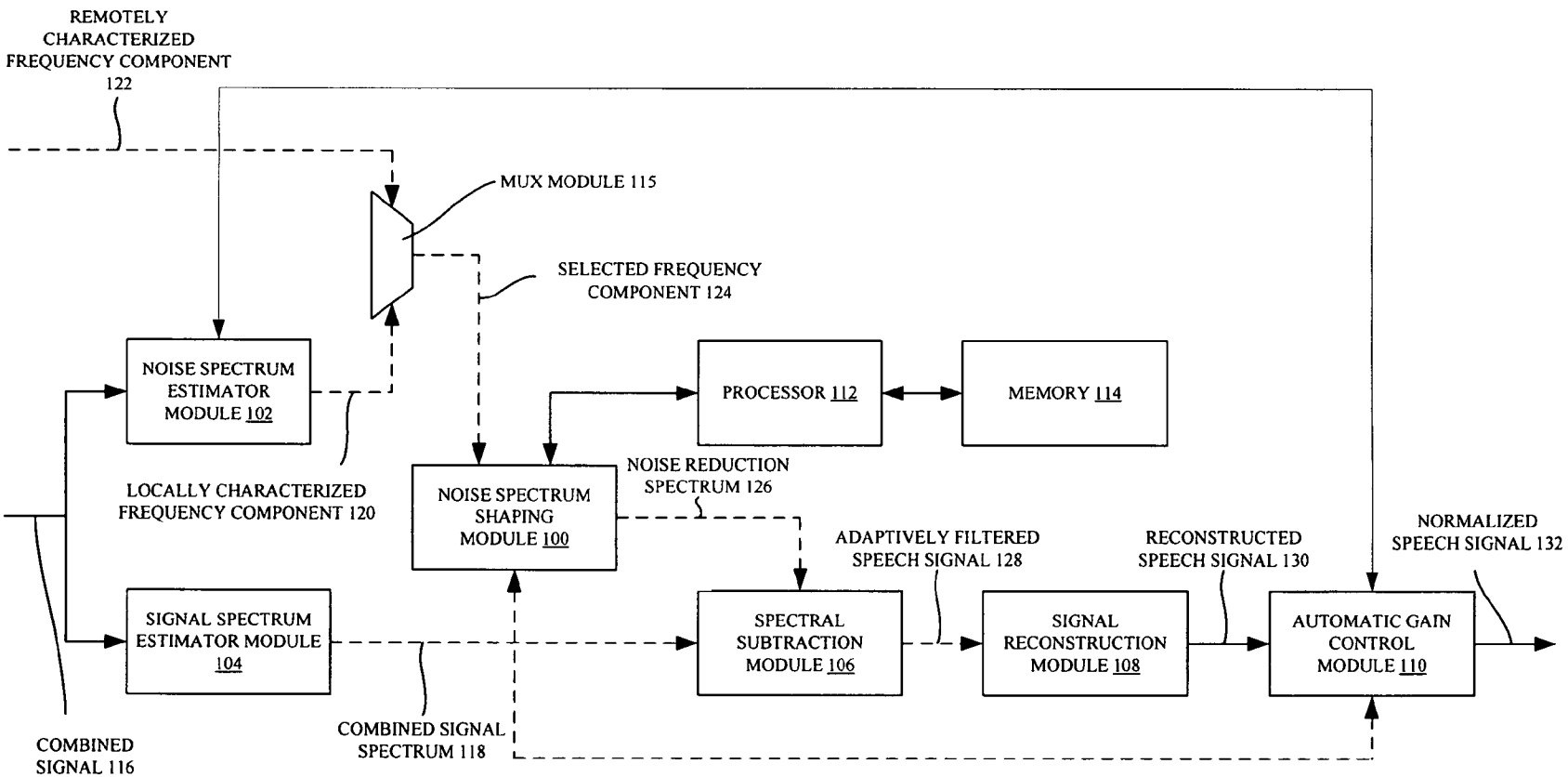
FIG. 1 is a schematic view of a system to subtract a shaped component of a noise reduction spectrum from a combined signal, according to one embodiment.

FIG. 1 is a schematic view of a system to subtract a shaped component of a noise reduction spectrum from a combined signal, according to one embodiment. Particularly, FIG. 1 illustrates a noise spectrum shaping module 100, a noise spectrum estimator module 102, a signal spectrum estimator module 104, a spectral subtraction module 106, a signal reconstruction module 108, an automatic gain control module 110, a processor 112, a memory 114, a mux module 115, a combined signal 116, a combined signal spectrum 118, a locally characterized frequency component 120, a remotely characterized frequency component 122, a selected frequency component 124, a noise reduction spectrum 126, an adaptively filtered speech signal 128, a reconstructed speech signal 130, and a normalized speech signal 132, according to one embodiment.

In an embodiment, the combined signal 116 is received by the noise spectrum estimator module 102 and the signal spectrum estimator module 104. The combined signal 116 may include both a noise signal and a speech signal. The combined signal 116 may be an audio signal captured using an electronic device, such as a digital still camera. The combined signal 116 may be acquired using a single microphone. The noise signal may be a background noise such as a stepper motor noise, wind noise in an outdoor environment, a mechanical noise from machinery operating nearby, or other noise signals. The speech signal may be human speech that is acquired independently or with a still image or a video image.

A noise set may include the noise sample spectrum. The noise set may be a group of frequency spectrums generated using one or more characterized samples of a background noise. A characterization sample of a background noise may cover a period of time that is divided into multiple windows. The noise sample spectrum may be one of several Fourier transformed samples of a background noise signal, which may be acquired using a windowing method. A frequency component of the noise sample spectrum may be a part of the noise sample spectrum that is limited to a particular frequency or range of frequencies.

The characterization sample of the background noise may be acquired locally or remotely. The local characterization sample may be acquired using a digital camera when a characterization instruction is received. A remotely acquired characterization sample of the background noise may be acquired at any time prior to the communication of the selected frequency component 124 to the noise spectrum shaping module 100. The remotely acquired characterization sample of the background noise may be obtained at any location. The remotely characterized frequency component 122 may be a part of a spectrum of the remotely acquired characterization sample. The remotely acquired characterization sample or remotely characterized frequency component 122 may be stored in memory 114 and/or transmitted to and received by an electronic device, such as a digital camera.

The characterization instruction may be associated with a user control signal, a motor operation, a voice activity detection, a time factor, or an environmental setting. The user control signal may be generated by a user of a digital camera. The motor operation may be a stepper motor that is used to zoom in and/or zoom out of an image by moving a focal distance of a digital camera. The voice activity detection may postpone acquisition of a noise characterization sample while a voice activity is detected, and it may allow a noise characterization sample to be captured when the voice activity is not detected. The characterization sample may be acquired during gaps in a conversation between words or sentences.

In an embodiment, the noise spectrum estimator module 102 identifies a selected frequency component 124 using a corresponding frequency component of a noise sample spectrum. The noise spectrum estimator module 102 may identify a locally characterized frequency component 120, which may be chosen as the selected frequency component 124 using a mux module 115. The mux module 115 may be used to choose either the remotely characterized frequency component 122 or the locally characterized frequency component 120 to be the selected frequency component 124.

In the embodiment, the selected frequency component 124 may be a spectral line that corresponds to a frequency to be analyzed in the noise spectrum shaping module 100. The selected frequency component 124 may be chosen or derived from one or more corresponding frequency components of windowed samples of the noise signal. The selected frequency component 124 may be an average or a maximum of one or more corresponding frequency components of windowed samples of the noise signal. The selected frequency component 124 may be chosen or determined using any other algorithm, selection method, or criterion with respect to the corresponding frequency components of windowed samples of the noise signal.

In an embodiment, the selected frequency component 124 may be obtained from either the remotely characterized frequency component 122 or the locally characterized frequency component 120 using the mux module 115. The remotely characterized frequency component 122 may include a maximum frequency component and/or an average frequency component, which may be predetermined using a previously obtained noise signal. The remotely characterized frequency component 122 may include any other frequency component automatically derived from one or more corresponding frequency components of the previously obtained noise signal. The previously obtained noise signal may be captured using multiple windows.

The noise spectrum shaping module 100 may algorithmically determine whether to use the selected frequency component 124 to generate a shaped component of the noise reduction spectrum 126. A threshold value may be used to algorithmically determine whether to use the selected frequency component 124 to generate the shaped component of the noise reduction spectrum 226. The threshold value may include a combined signal frequency component 246 multiplied by an amplification factor. The combined signal frequency component 246 may be a part of the combined signal spectrum 118.

In the embodiment, the noise spectrum shaping module 100 forms a shaped component of a noise reduction spectrum 126 using the processor 112 and the memory 114 based on the combined signal spectrum 118 and the selected frequency component 124. The shaped component of the noise reduction spectrum 226 may include a largest corresponding frequency component 242 when the largest corresponding frequency component 242 is less than a threshold value. The shaped component of the noise reduction spectrum 226 may include an average of corresponding frequency components 244 of the noise set when the largest corresponding frequency component 242 is less than a threshold value. The operation of the noise spectrum shaping module 100 may also be better understood by referring to FIG. 2.

In the embodiment, the spectral subtraction module 106 subtracts the shaped component of the noise reduction spectrum 126 from the combined signal spectrum 118. The spectral subtraction module 106 may generate an adaptively filtered speech signal 128 that is communicated to the signal reconstruction module 108. The signal reconstruction module 108 may reconstruct an adaptively filtered speech signal 128 to generate the reconstructed speech signal 130, which may be communicated to the automatic gain control module 110. The automatic gain control module 110 may normalize a signal level of a reconstructed speech signal 130.

Figure 2:
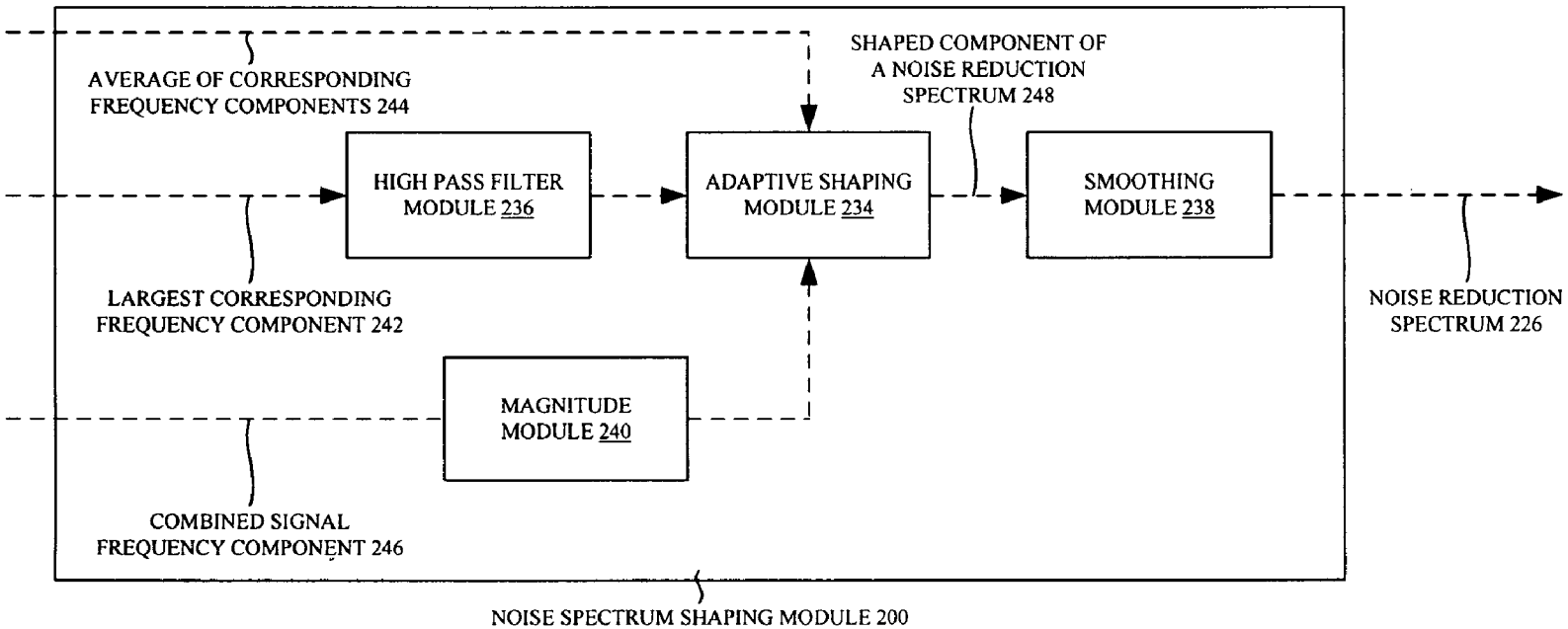
FIG. 2 is an expanded view of a noise spectrum shaping module, according to one embodiment.

FIG. 2 is an expanded view of a noise spectrum shaping module, according to one embodiment. Particularly, FIG. 2 illustrates a noise spectrum shaping module 200, a noise reduction spectrum 226, an adaptive shaping module 234, a high pass filter module 236, a smoothing module 238, a magnitude module 240, a largest corresponding frequency component 242, a combined signal frequency component 246, an average of corresponding frequency components 244, and a shaped component of a noise reduction spectrum 248, according to one embodiment.

The noise spectrum shaping module 200 may be the noise spectrum shaping module 100. The average of corresponding frequency components 244 and the largest corresponding frequency component 242 may be obtained from or derived from the noise reduction spectrum 126. The noise reduction spectrum 126 may include each spectrum of a windowed sample of a background noise signal, and the noise reduction spectrum 126 may include multiple frequency components. The largest corresponding frequency component 242 may be the largest frequency component for a given frequency or frequency range based on the windowed samples of the background noise signal. The average of corresponding frequency components 244 may be the average of multiple windowed samples for a given frequency or frequency range. The combined signal frequency component 246 may be a part of the combined signal spectrum 118 that is limited to a particular frequency or range of frequencies. The magnitude of the combined signal frequency component 246 may be acquired using the magnitude module 240 and communicated to the adaptive shaping module 234. The largest corresponding frequency component 242 may be passed through a high pass filter module 236 before being received by the adaptive shaping module 234.

The adaptive shaping module 234 of the noise spectrum shaping module 200 may algorithmically determine whether to use the selected frequency component 124 to generate the shaped component of the noise reduction spectrum 248. A threshold value may be used as part of the algorithm, and the threshold value may include a combined signal frequency component 246 multiplied by an amplification factor. The selected frequency component 124 may be the corresponding frequency component of any particular noise sample, a largest corresponding frequency component 242 of the noise samples, or the average of the corresponding frequency components 244 of multiple noise samples.

In an embodiment, when a speech signal is not present, the adaptive shaping module 234 may determine that the largest corresponding frequency component 242 should be used to generate the shaped component of the noise reduction spectrum 248. The shaped component of the frequency in question may be formed to include the magnitude of the largest corresponding frequency component 242.

In an embodiment, when a speech signal is present, the magnitude of the largest corresponding frequency component 242 may be compared against the magnitude of the frequency component of the combined signal 116 scaled by the amplification factor. The amplification factor may be approximately $10^{(\beta/20)}$, with $\beta=12$. The amplification factor may be approximately 3.981. The comparison may determine whether an average of corresponding frequency components 244 or a largest corresponding frequency component 242 is used to form a shaped component of the noise reduction spectrum 248. The noise reduction spectrum 126 may therefore vary between different frequencies depending on the results of the comparison, which may result in a reduction of a noise frequency subtraction to preserve a speech signal energy.

In the embodiment, when the largest corresponding frequency component 242 is larger than the magnitude of the frequency component of the combined signal scaled by the amplification factor, the average of the corresponding frequency components 244 of multiple noise samples may form the shaped component of the noise reduction spectrum 248. The shaped component may include the magnitude of the average of the corresponding frequency components 244.

In the embodiment, using the largest corresponding frequency component 242 to form the shaped component of the noise reduction spectrum 248 may result in a loss of speech energy, which may reduce a speech intelligibility. Using the average of the corresponding frequency components 244 may allow subtraction to occur while preserving speech energy.

In an embodiment, the adaptive shaping module 234 of the noise spectrum shaping module 200 may dynamically generate a spectral magnitude curve between a spectrum composed of the largest magnitude frequency components of noise samples and a spectrum composed of a running average of the frequency components of the noise samples. The adaptation of the noise reduction spectrum 226 may preserve a natural sound in speech segments while suppressing a noise signal. The adaptation may allow the noise spectrum shaping module 200 to adapt to a noise spectrum that varies in time.

In an embodiment, the adaptive shaping module 234 of the noise spectrum module may operate in accordance with the following:

```
maxNMag = max (Nmag__max(excluding non-speech spectral lines));
maxSMag = max(S+Nmag(excluding non-speech spectral lines));
IF (maxSMag > maxNMag ) OR (Voice Activity = TRUE)
  SNthr__sf= 10^(SNthr__dB/20); -- Apply amplification level for signal
  level threshold
  FOR ix = each frequency line excluding non-speech spectral lines in
  1st half
    IF Nmag__max[ix] > ( S+Nmag[ix] × SNthr__sf)
      Nmag[ix] = Nmag__avg[ix]; -- use running average for noise
      spectrum magnitude
    ELSE
      Nmag[ix] = Nrnag__max[ix]; -- use maximum for noise spectrum
      magnitude
    END
  END
  -- Symmetry creation
  Create symmetry by duplicating first half mirror image in 2nd half
  magnitude spectrum;
ELSE
  Nmag= Nmag__max; -- use maximum for noise spectrum magnitude
END
```

In the embodiment, maxSMag may represent the energy of the highest energy frequency component in the input signal, and maxNMag may represent the energy of the highest energy noise spectrum component. SNthr_sf may represent an amplification factor, and SNthr_dB may correspond to the variable β. In the embodiment, Nmag[ix] may represent the shaped component of the noise reduction spectrum 248, Nmag_avg[ix] may represent the average of corresponding frequency components 244, and Nmag_max[ix] may represent the largest corresponding frequency component 242. In the embodiment, S+Nmag[ix] may represent the combined signal frequency component 246, and it may be scaled by the factor SNthr_sf when compared with Nmag_max[ix].

The noise spectrum shaping module 200 may modify a low frequency magnitude spectrum, and it may include a smoothing module 238 that reduces sharp transitions between frequency components of the noise reduction spectrum 226. The sharp transitions of the noise reduction spectrum 226 may be modified by increasing or decreasing the magnitude of a frequency component of the noise reduction spectrum 226. The smoothing module 238 may include a low pass filter, such as a bi-quadratic filter. The bi-quadratic filter may be as given by the following: b0*y[n]=a0*x[n]−a1*x[n−1]+a2*x[n−2]−b1*y[n−1]−b2*y[n−2], wherein the coefficients a0, a1, a2, b0, b1, and b2 may be programmable. A Butterworth filter design may reduce ripples in a pass band and a stop band.

The high pass filter module 236 may amplify a frequency line of a noise reduction spectrum that corresponds to a frequency below a human speech threshold. The amplified frequencies may range from 0 Hz to 80 Hz. The amplification may increase in frequency until reaching unity. The envelope of the amplifier response may be triangular or cosine. The spectral alteration on the left side may be replicated on the right side of the magnitude spectrum to maintain symmetry. The amplification of the lower frequency range of the noise reduction spectrum 226 may act as high pass filtering in a spectral subtraction stage by reducing the adaptively filtered speech signal 128 in frequency ranges below a human speech frequency.

In an embodiment, the high pass filter of the noise spectrum shaping module 200 may be 80 Hz. The smoother may include a Butterworth low pass filter with a cut-off of 0.25 with 1.0 corresponding to half sampling rate. The coefficients may be substantially a0=0.097631, a1=0.195262, a2=0.097631, b0=1.0, b1=−0.942809, and b2=0.333333. The signal scale factor β may be 12 dB. In another embodiment, a dynamically computed signal scale factor β may be used.

Figure 3:
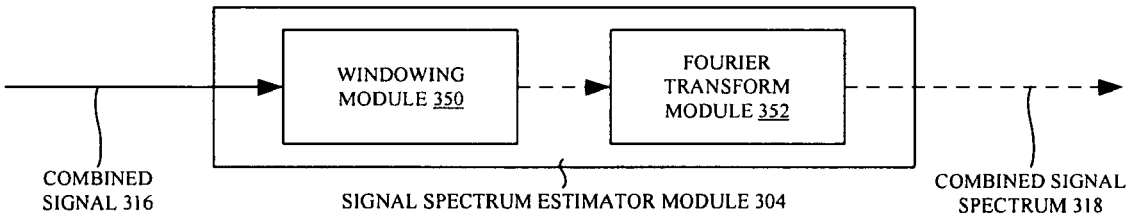
FIG. 3 is an expanded view of a signal spectrum estimator module, according to one embodiment.

FIG. 3 is an expanded view of a signal spectrum estimator module 304, according to one embodiment. Particularly, FIG. 3 illustrates a combined signal 316, a combined signal spectrum 318, a windowing module 350, and a Fourier transform module 352, according to one embodiment.

In an embodiment, the combined signal 316 may be sampled using a windowing technique in the windowing module 350. The combined signal 316 may include a noise signal and another audio signal. A windowed sample of the combined signal 316 may then be communicated to the Fourier transform module 352. The Fourier transform module 352 may convert the windowed sample from a time domain to a frequency domain to generate the combined signal spectrum 318. The Fourier transform module 352 may use any type of Fourier transform method, such as a Fast Fourier Transform or a Discrete Fourier Transform.

In an embodiment, a Fast Fourier Transform may be used to perform transformation from a time domain to a frequency domain. A Fast Fourier Transform length of 512 may be used. A quality threshold of the noise filter transforms may be approximately 96 dB on Fast Fourier Transform and Inverse Fast Fourier Transform operations using fixed point arithmetic. Various Fast Fourier Transform algorithms may be used, including Radix-2 FFT, Radix-4 FFT, Split Radix FFT, and Radix-8 FFT.

In another embodiment, various window types may be used. A Blackman-Harris window may be used, and it may have an approximately 75% overlap. A Tukey window with alpha equal to 0.5 may be used with a 25% overlap. A Hanning window with alpha equal to 2, sine squared, and 50% overlap may also be used.

Figure 4:
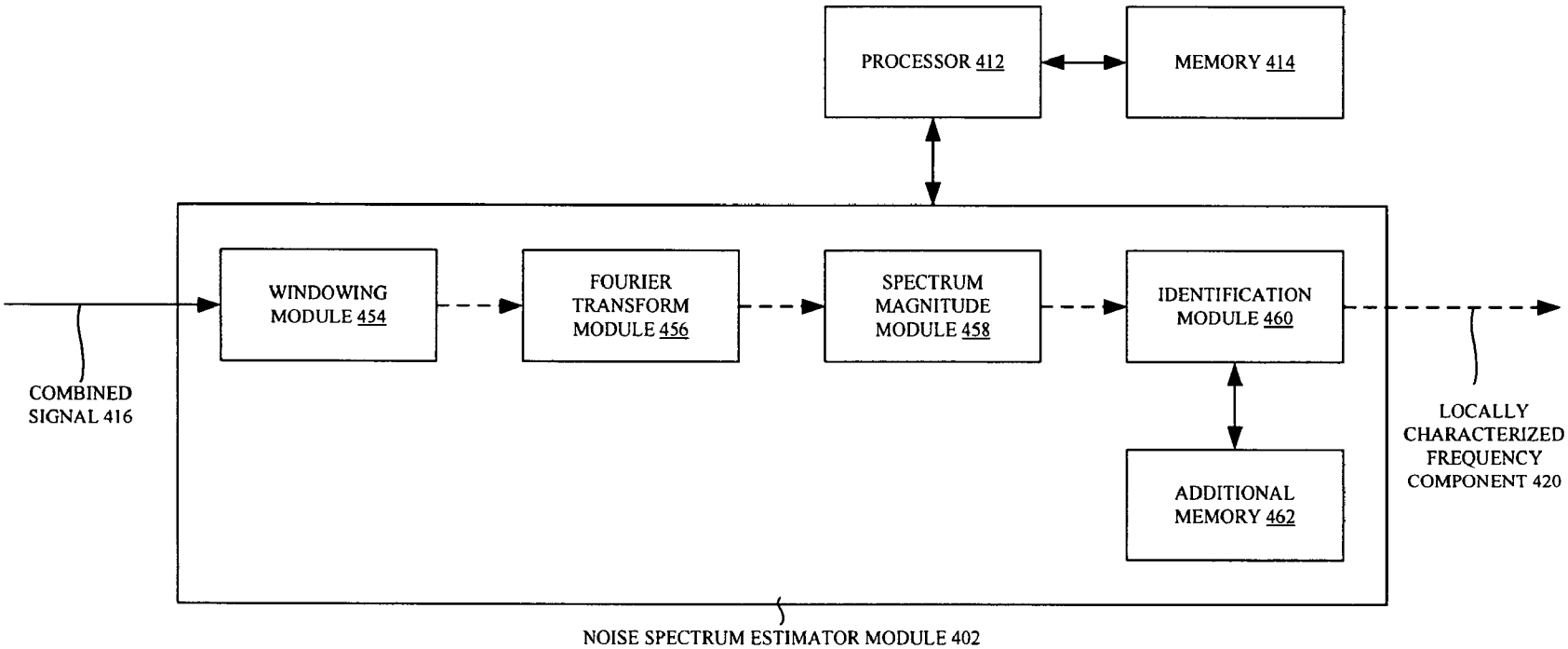
FIG. 4 is an expanded view of a noise spectrum estimator module, according to one embodiment.

FIG. 4 is an expanded view of a noise spectrum estimator module 402, according to one embodiment. Particularly, FIG. 4 illustrates a processor 412, a memory 414, a combined signal 416, a locally characterized frequency component 420, a windowing module 454, a Fourier transform module 456, a spectrum magnitude module 458, an identification module 460, and an additional memory 462, according to one embodiment. The processor 412 may be the processor 112, the memory 414 may be the memory 114, and the combined signal 416 may be the combined signal 116. In addition, the locally characterized frequency component 420 may be the locally characterized frequency component 120.

The noise spectrum estimator module 402 may generate a locally characterized frequency component 420 or a remotely characterized frequency component 122. The locally characterized frequency component 420 may be computed real-time from the combined signal 116. The remotely characterized frequency component 122 may be determined using a most probabilistic noise signal. The locally characterized frequency component 420 or the remotely characterized frequency component 122 may be computed using a combination of real-time and off line processing.

In an embodiment, noise may be computed dynamically from an input signal, such as the combined signal 116. A voice activity detection module may detect a voice activity. When a signal segment of a combined signal 116 does not contain a voice signal, noise estimation may be performed. The combined signal 116 may be divided into windows using the windowing module 454. Overlapping windows may be used to reduce a spectral leakage. The noise signal spectrum may be estimated by performing a Fast Fourier Transform on overlapping windows using the Fourier transform module 456. The magnitude spectrum may be computed using the spectrum magnitude module 458, and a maximum and a running average of each frequency component across overlapping windows may be stored in the additional memory 462 using the memory 414 using the identification module 460. In the absence of a noise spectral adaptation, the maximum of each frequency component may be used as the shaped component of the noise reduction spectrum 248. The shaped component of the noise reduction spectrum 248 may be limited to a most recent signal in time to reduce a potential for a peak noise to override a combined signal 116.

In another embodiment, a user interface may characterize a noise signal, which may be a stepper motor noise. The user may trigger the start and/or stop of the noise characterization, which may record the audio input. The noise characterization may include a zoom in and zoom out operation so the resultant noise may be recorded. During or after the recording process, the captured noise signal spectrum may be estimated. The captured noise signal spectrum may include the largest corresponding frequency component 242 and the average of corresponding frequency components 244. The resulting captured noise signal spectrum may include the largest noise spectral magnitude in each spectral line of the background and stepper motor noise during stepper motor activity.

In yet another embodiment, the remotely characterized frequency component 122 may be estimated and stored in a memory 114 of an electronic device, such as a digital camera. The remotely characterized frequency component 122 may include the largest corresponding frequency component 242 and the average of corresponding frequency components 244.

In a further embodiment, real time and offline noise estimation may be combined. A noise signal, such as a stepper motor noise, may be stored in memory 114. A background noise may be estimated using a voice activity detection module to acquire samples when a voice activity is not detected. A background noise may be estimated using a noise characterization mode. The largest corresponding frequency component 242 and the average of corresponding frequency components 244 using both the offline noise estimation and the real time noise estimation samples.

Figure 5:
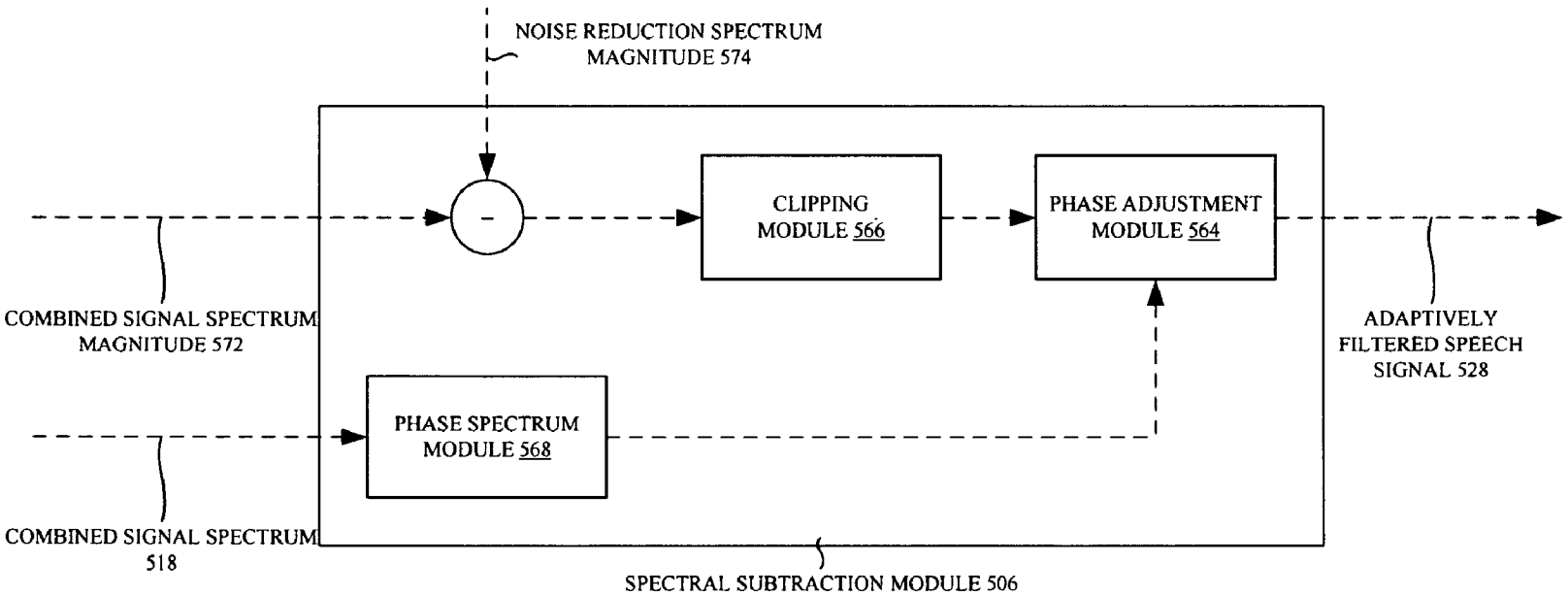
FIG. 5 is an expanded view of a spectral subtraction module, according to one embodiment.

FIG. 5 is an expanded view of a spectral subtraction module 506, according to one embodiment. Particularly, FIG. 5 illustrates a combined signal spectrum 518, an adaptively filtered speech signal 528, a phase adjustment module 564, a clipping module 566, a phase spectrum module 568, a combined signal spectrum magnitude 572, and a noise reduction spectrum magnitude 574, according to one embodiment.

The noise reduction spectrum magnitude 574 may be subtracted from the combined signal spectrum magnitude 572 in the spectral subtraction module 506. The noise sample spectrum may be removed in case the result has negative values. The negative valued results may be clipped to zero level in the clipping module 566.

The subtraction of the noise reduction spectrum magnitude 574 from the combined signal spectrum magnitude 572 may remove noise energy from the spectral lines of the combined signal 116. In an example embodiment, zoom operations of a digital camera involve the use of a stepper motor. Noise patterns of the stepper motor may be loaded or captured, and the spectral subtraction module 506 may subtract the noise patterns from the combined signal 116. Internal signals in the digital camera may be tapped to detect the stepper motor activity.

The phase spectrum module 568 may acquire the phase of the combined signal spectrum 518. The phase may be communicated to the phase adjustment module 564. The phase of the combined signal spectrum 518 may be used to determine the phase of the adaptively filtered speech signal 528.

Figure 6:
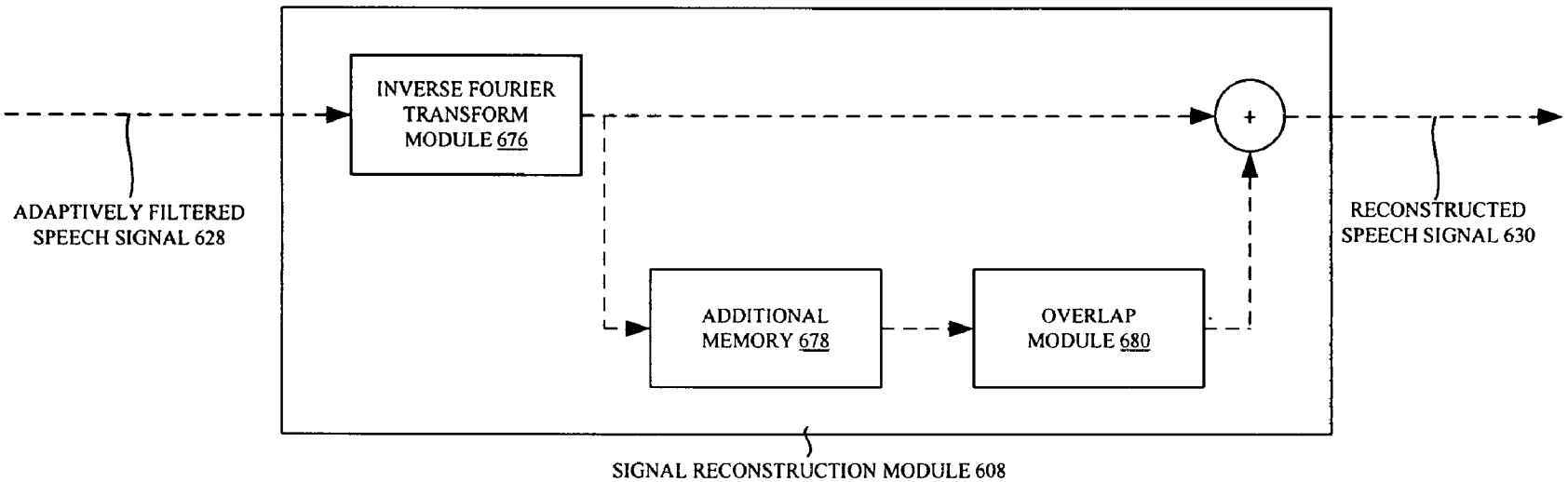
FIG. 6 is an expanded view of a signal reconstruction module, according to one embodiment.

FIG. 6 is an expanded view of a signal reconstruction module 608, according to one embodiment. Particularly, FIG. 6 illustrates an adaptively filtered speech signal 628, an inverse Fourier transform module 676, an additional memory 678, an overlap module 680, and a reconstructed speech signal 630 according to one embodiment.

The adaptively filtered speech signal 628 may be received by the inverse Fourier transform module 676 of the signal reconstruction module 608. The inverse Fourier transform module 676 may generate a time domain sample of the input signal for each overlapped window of the signal spectrum estimator module 104. The time domain samples with an overlap may be added together using the additional memory 678 and the overlap module 680 to generate the reconstructed speech signal 630.

Figure 7:
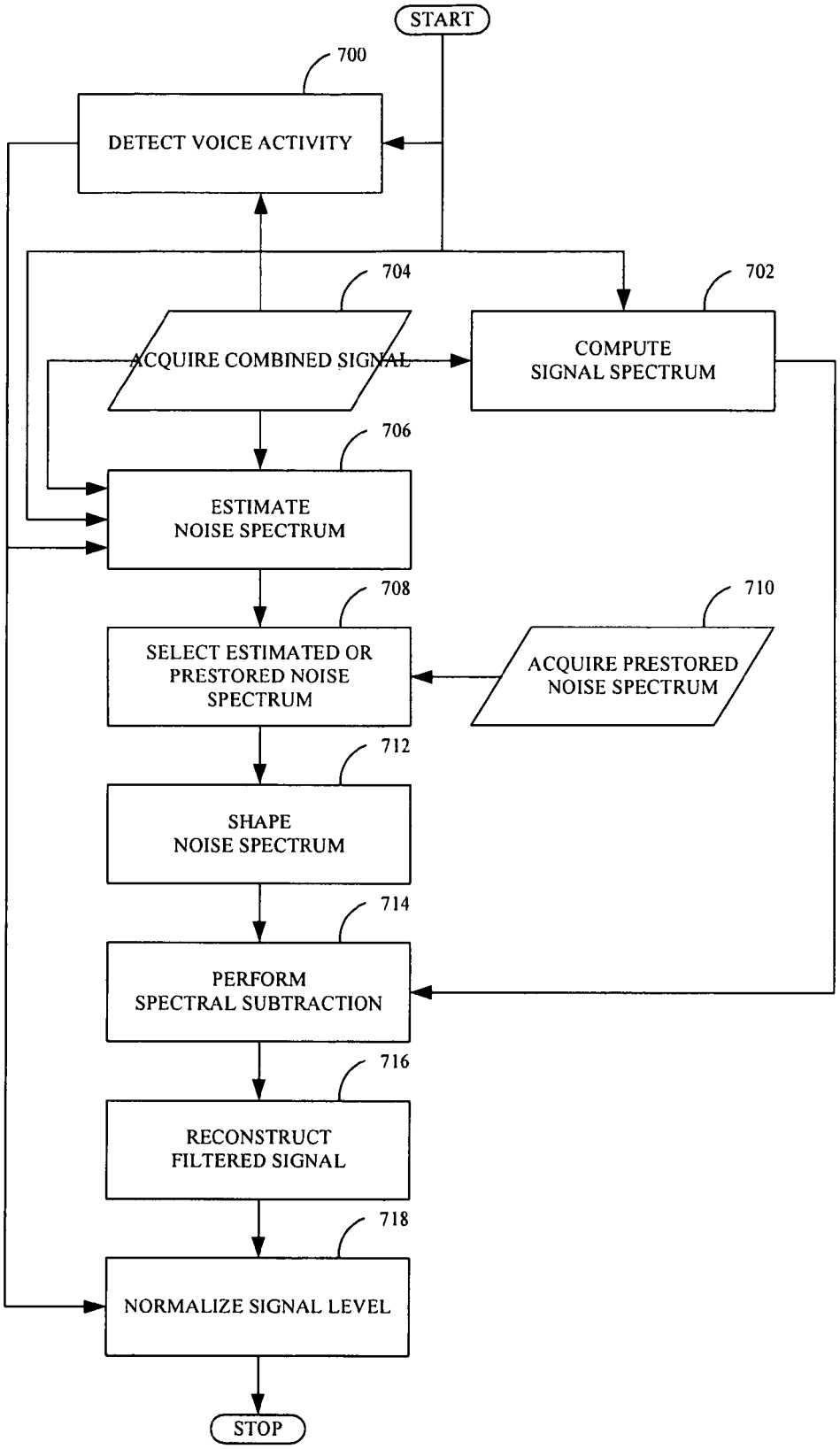
FIG. 7 is a block diagram illustrating subtraction of a shaped component of a noise reduction spectrum from a combined signal, according to one embodiment.

FIG. 7 is a block diagram illustrating subtraction of a shaped component of a noise reduction spectrum from a combined signal, according to one embodiment. In operation 700, a voice activity may be detected. A voice activity detector may be used to indicate whether a voice activity is present in the combined signal 116. The voice activity detector may be used to allow noise estimation to occur during gaps in speech. The voice activity detector may also be used to indicate whether an average or a largest frequency component should be used to form the shaped component of the noise reduction spectrum 248.

In operation 702, a combined signal spectrum 118 may be computed. The combined signal spectrum 118 may be acquired from the combined signal 116 using the signal spectrum estimator module 104. The combined signal 116 may be acquired in operation 704. In operation 706, the noise spectrum may be estimated using the noise spectrum estimator module 102. The noise spectrum may include the locally characterized frequency component 120, which may be acquired during an absence of voice activity. The noise spectrum may be estimated remotely, and a remotely characterized frequency component 122 may be generated and stored in a memory 114. The remotely characterized frequency component 122 and the locally characterized frequency component 120 may include an average of corresponding frequency components 244 or a largest corresponding frequency component 242. The noise spectrum may be estimated using the combined signal 116.

In operation 708, an estimated or prestored noise spectrum may be selected to generate the shaped component of the noise reduction spectrum 248. The prestored noise spectrum may be acquired in operation 710 from the memory 114. In operation 712, the noise spectrum may be shaped by the noise spectrum shaping module 100 to include one or both of the average of corresponding frequency components 244 and the largest corresponding frequency component 242.

In operation 714, spectral subtraction of the noise reduction spectrum 126 from the combined signal spectrum 118 may be performed by the spectral subtraction module 106. In operation 716, a reconstructed speech signal 130 may be formed by the signal reconstruction module 108. In operation 718, a signal level of the reconstructed speech signal 130 may be normalized by the automatic gain control module 110, which may generate the normalized speech signal 132.

Figure 8:
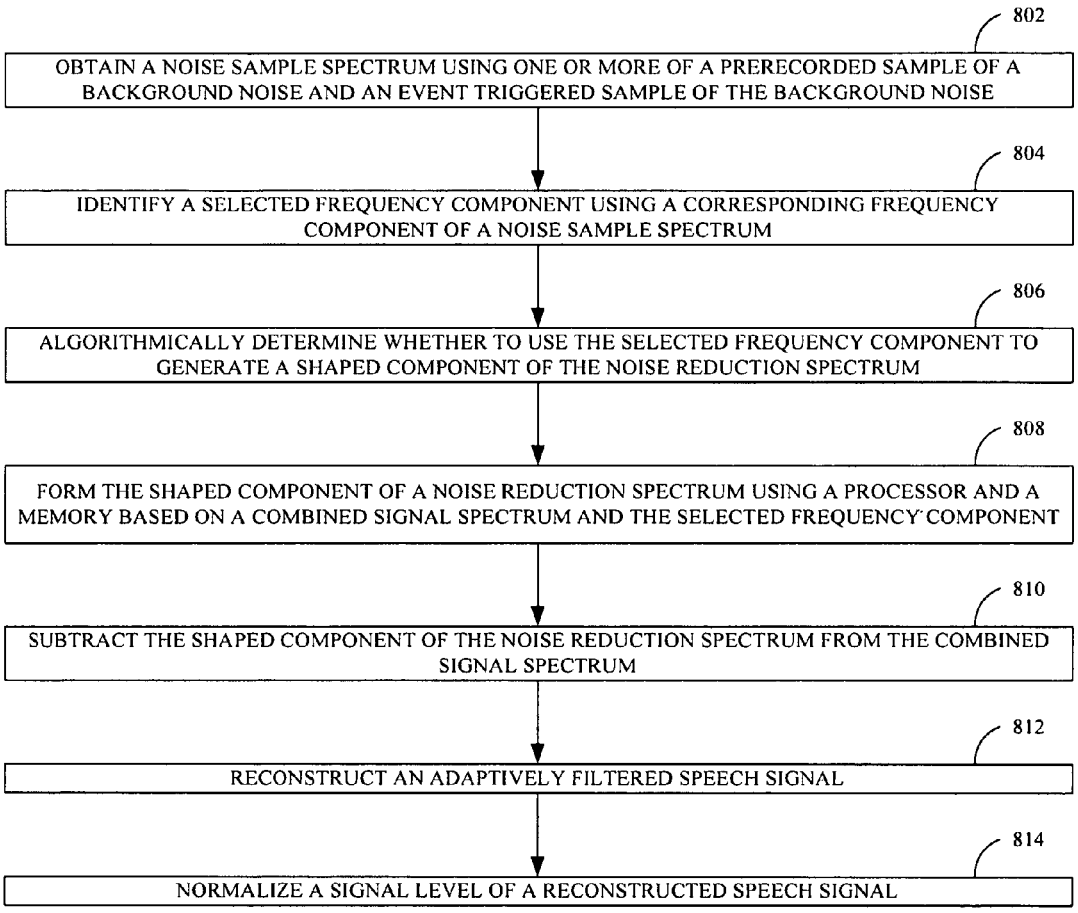
FIG. 8 is a process flow diagram illustrating identification of a selected frequency component using a corresponding frequency component of a noise sample spectrum among other operations, according to one embodiment.

FIG. 8 is a process flow diagram illustrating identification of a selected frequency component using a corresponding frequency component of a noise sample spectrum among other operations, according to one embodiment.

In the embodiment, in operation 802, a noise sample spectrum is obtained using at least one of a prerecorded sample of a background noise and a locally characterized sample of the background noise. In operation 804, a selected frequency component 124 is identified using a corresponding frequency component of a noise sample spectrum. In operation 806, an algorithmic determination is made whether to use the selected frequency component 124 to generate a shaped component of the noise reduction spectrum 248. A threshold value is used to algorithmically determine whether to use the selected frequency component 124 to generate a shaped component of the noise reduction spectrum 248.

In the embodiment, in operation 808, the shaped component of a noise reduction spectrum 248 is formed using a processor 112 and a memory 114 based on a combined signal spectrum 118 and the selected frequency component 124. In operation 810, the shaped component of the noise reduction spectrum 248 is subtracted from the combined signal spectrum 118. In operation 812, an adaptively filtered speech signal 128 is reconstructed. In operation 814, a signal level of a reconstructed speech signal 130 is normalized.

Figure 9:
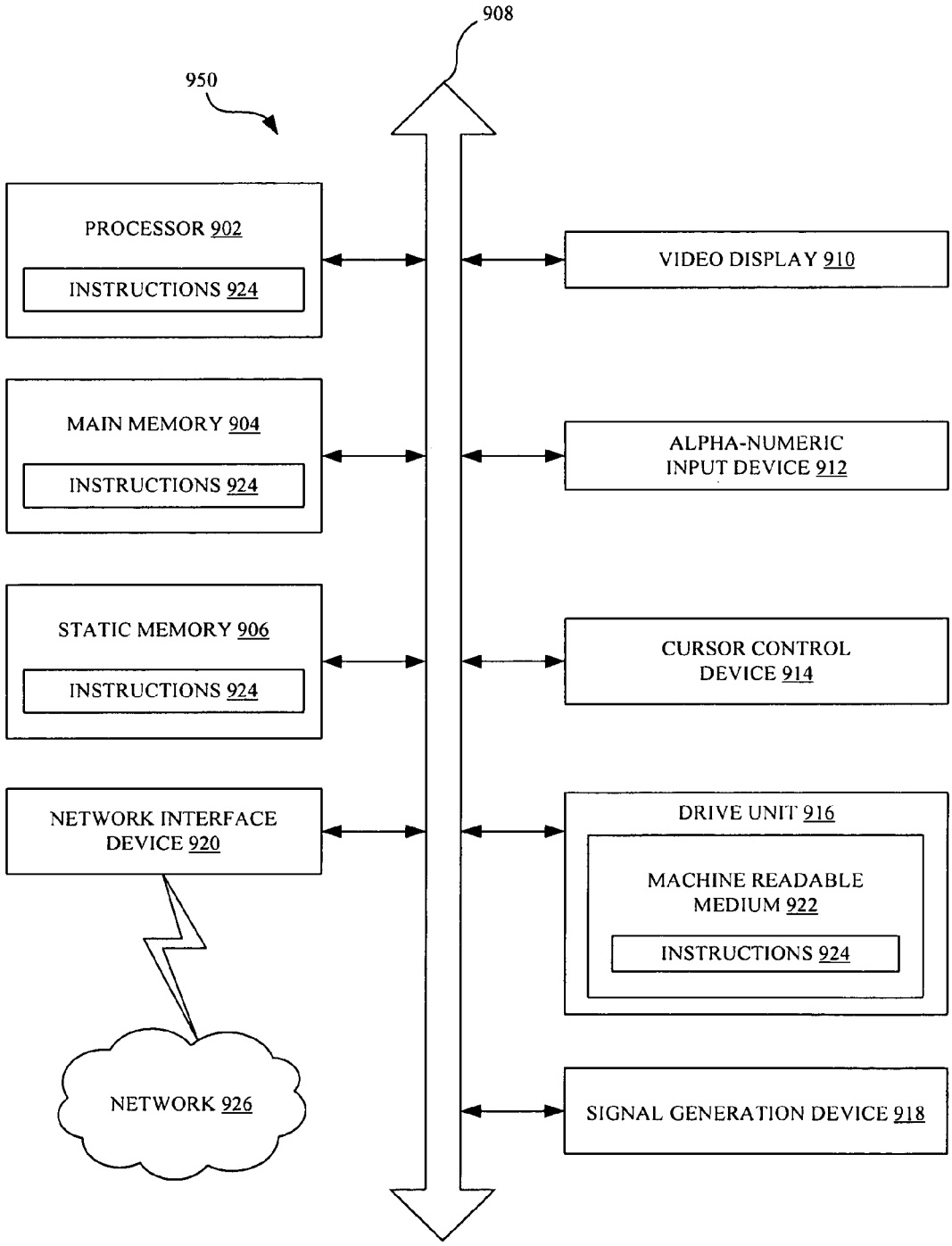
FIG. 9 is a diagrammatic system view of a data processing system in which any of the embodiments disclosed herein may be performed, according to one embodiment.

FIG. 9 is a diagrammatic system view of a data processing system in which any of the embodiments disclosed herein may be performed, according to one embodiment. In particular, the diagrammatic system view 950 of FIG. 9 illustrates a processor 902, a main memory 904, a static memory 906, a bus 908, a video display 910, an alpha-numeric input device 912, a cursor control device 914, a drive unit 913, a signal generation device 918, a network interface device 920, a machine readable medium 922, instructions 924, and a network 926, according to one embodiment.

The diagrammatic system view 950 may indicate a personal computer and/or the data processing system in which one or more operations disclosed herein are performed. The processor 902 may be a microprocessor, a state machine, an application specific integrated circuit, a field programmable gate array, etc. (e.g., an Intel® Pentium® processor). The main memory 904 may be a dynamic random access memory and/or a primary memory of a computer system. The static memory 906 may be a hard drive, a flash drive, and/or other memory associated with the data processing system. The bus 908 may be an interconnection between various circuits and/or structures of the data processing system. The video display 910 may provide a graphical representation of information on the data processing system. The alpha-numeric input device 912 may be a keypad, a keyboard and/or any other input device of text (e.g., a special device to aid the physically handicapped).

The cursor control device 914 may be a pointing device such as a mouse. The drive unit 916 may be the hard drive, a storage system, and/or other longer term storage subsystem. The signal generation device 918 may be a bios and/or a functional operating system of the data processing system. The network interface device 920 may be a device that performs interface functions such as code conversion, protocol conversion and/or buffering required for communication to and from the network 926. The machine readable medium 922 may provide instructions on which any of the methods disclosed herein may be performed. The instructions 924 may provide source code and/or data code to the processor 902 to enable any one or more operations disclosed herein.

Although the present embodiments have been described with reference to specific example embodiments, it will be evident that various modifications and changes may be made to these embodiments without departing from the broader spirit and scope of the various embodiments. For example, the various devices, modules, analyzers, generators, etc. described herein may be enabled and operated using hardware circuitry (e.g., CMOS based logic circuitry), firmware, software and/or any combination of hardware, firmware, and/or software (e.g., embodied in a machine readable medium).

In addition, it will be appreciated that the various operations, processes, and methods disclosed herein may be embodied in a machine-readable medium and/or a machine accessible medium compatible with a data processing system (e.g., a computer system), and may be performed in any order (e.g., including using means for achieving the various operations). Accordingly, the specification and drawings are to be regarded in an illustrative rather than a restrictive sense.

What is claimed is:

1. A method, comprising:

identifying a selected frequency component using a corresponding frequency component of a noise sample spectrum, wherein a noise set is comprised of the noise sample spectrum;

forming a shaped component of a noise reduction spectrum using a processor and a memory based on a combined signal spectrum and the selected frequency component; and subtracting the shaped component of the noise reduction spectrum from the combined signal spectrum and algorithmically determining whether to use the selected frequency component to generate the shaped component of the noise reduction spectrum.

2. The method of claim 1, wherein a threshold value is used to algorithmically determine whether to use the selected frequency component to generate the shaped component of the noise reduction spectrum, wherein the threshold value is comprised of a combined signal frequency component multiplied by an amplification factor.

3. The method of claim 2, wherein the shaped component of the noise reduction spectrum is comprised of a largest corresponding frequency component of the noise set when the largest corresponding frequency component is less than the threshold value.

4. The method of claim 2, wherein the shaped component of the noise reduction spectrum is comprised of an average of corresponding frequency components of the noise set when a largest corresponding frequency component is greater than the threshold value.

5. The method of claim 1, wherein the shaped component of the noise reduction spectrum is comprised of a largest corresponding frequency component of the noise set when a voice activity is absent.

6. The method of claim 1, wherein the noise sample spectrum is obtained using at least one of a remotely characterized sample of a background noise and a locally characterized sample of the background noise.

7. The method of claim 6, wherein the locally characterized sample is acquired based on at least one of a user control signal, a motor operation, a voice activity detection, a time factor, and an environmental setting.

8. The method of claim 7, wherein the locally characterized sample of the background noise is acquired using a gap in a voice activity.

9. The method of claim 1, further comprising reconstructing an adaptively filtered speech signal.

10. The method of claim 9, further comprising normalizing a signal level of a reconstructed speech signal.

11. The method of claim 10, further comprising:

causing a machine to perform the method of claim 10 by executing a set of instructions embodied by the method of claim 10 in a form of a machine readable medium.

12. An apparatus for noise reduction, comprising:

a noise spectrum estimator module to identify a selected frequency component using a corresponding frequency component of a noise sample spectrum, wherein a noise set is comprised of the noise sample spectrum;

a noise spectrum shaping module to form a shaped component of a noise reduction spectrum using a processor and a memory based on a combined signal spectrum and the selected frequency component and to algorithmically determine whether to use the selected frequency component to generate the shaped component of the noise reduction spectrum; and a spectral subtraction module to subtract the shaped component of the noise reduction spectrum from the combined signal spectrum.

13. The apparatus of claim 12, wherein a threshold value is used to algorithmically determine whether to use the selected frequency component to generate the shaped component of the noise reduction spectrum, wherein the threshold value is comprised of a combined signal frequency component multiplied by an amplification factor.

14. The apparatus of claim 13, wherein the shaped component of a noise reduction spectrum is comprised of a largest corresponding frequency component of the noise set when the largest corresponding frequency component is less than the threshold value.

15. The apparatus of claim 13, wherein the shaped component of a noise reduction spectrum is comprised of an average of corresponding frequency components of the noise set when a largest corresponding frequency component is greater than the threshold value.

16. The apparatus of claim 12, wherein the shaped component of a noise reduction spectrum is comprised of a largest corresponding frequency component of the noise set when a voice activity is absent.

17. The apparatus of claim 12, wherein the noise sample spectrum is obtained using at least one of a prerecorded sample of a background noise and a locally characterized sample of the background noise.

18. A method, comprising:

obtaining a noise sample spectrum using at least one of a prerecorded sample of a background noise and a locally characterized sample of the background noise;

identifying a selected frequency component using a corresponding frequency component of a noise sample spectrum, wherein a noise set is comprised of the noise sample spectrum, and wherein the noise sample spectrum is obtained using at least one of a prerecorded sample of the background noise and a locally characterized sample of the background noise;

algorithmically determining whether to use the selected frequency component to generate a shaped component of the noise reduction spectrum, wherein a threshold value is used to algorithmically determine whether to use the selected frequency component to generate a shaped component of the noise reduction spectrum, wherein the threshold value is comprised of a combined signal frequency component multiplied by an amplification factor;

forming the shaped component of a noise reduction spectrum using a processor and a memory based on a combined signal spectrum and the selected frequency component, wherein the shaped component of a noise reduction spectrum is comprised of a largest corresponding frequency component of the noise set when the largest corresponding frequency component is less than the threshold value, and wherein the shaped component of a noise reduction spectrum is comprised of an average of corresponding frequency components of the noise set when the largest corresponding frequency component is greater than the threshold value;

subtracting the shaped component of the noise reduction spectrum from the combined signal spectrum;

reconstructing an adaptively filtered speech signal; and normalizing a signal level of a reconstructed speech signal.

* * * * *